United States Patent [19]

Tong

[11] Patent Number: 4,972,610

[45] Date of Patent: Nov. 27, 1990

[54] PROTECTIVE FOOT COVERING

[76] Inventor: Milton Tong, 220 Lathrop Ave., San Francisco, Calif. 94134

[21] Appl. No.: 381,465

[22] Filed: Jul. 18, 1989

[51] Int. Cl.[5] ..... A43B 3/16; A43B 3/12

[52] U.S. Cl. ..... 36/7.1 R; 36/7.5; 36/115

[58] Field of Search ..... 36/11.5, 7.1 R, 7.3, 36/7.4, 7.5

[56] References Cited

U.S. PATENT DOCUMENTS

| | | | |
|---|---|---|---|
| 1,310,358 | 7/1919 | Manderfield | 36/7.5 |
| 2,226,110 | 12/1940 | Bass | 36/11.5 |
| 2,299,500 | 10/1942 | Sawyer | 36/11.5 |
| 2,853,806 | 9/1958 | White | 36/11.5 |
| 3,290,802 | 12/1966 | Fukuoka | 36/11.5 |
| 4,793,075 | 12/1988 | Thatcher | 36/11.5 |
| 4,896,440 | 1/1990 | Salaverria | 36/11.5 |

*Primary Examiner*—Steven N. Meyers
*Attorney, Agent, or Firm*—Leon Gilden

[57] ABSTRACT

A protective foot covering arrangement is set forth wherein a polymeric covering is provided for overlying an individual's shoe upon entering a dwelling. The covering includes an embodiment provided with a "V" shaped slot formed within a top panel of the shoe terminating from a rear edge of the panel and terminating to the toe portion of the shoe. A flexible tab is secured to a heel portion of the covering. Variations of the instant invention include a mesh top portion or a Spandex covering overlying the sole of either a continuous one-piece upper portion or of an interlaced mesh construction. The sole may include openings for receiving dirt and the like to direct such debris from the shoe to an interior portion of the sole.

1 Claim, 4 Drawing Sheets

FIG 7
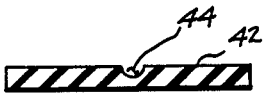
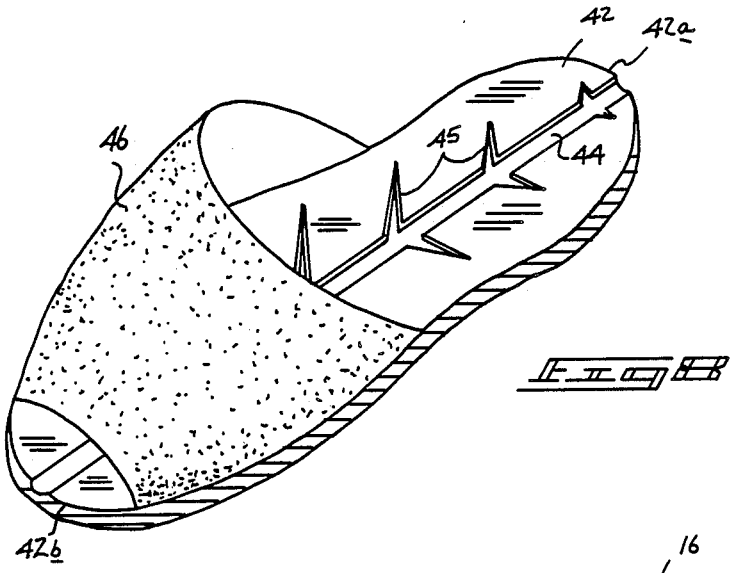
FIG 8
FIG 9
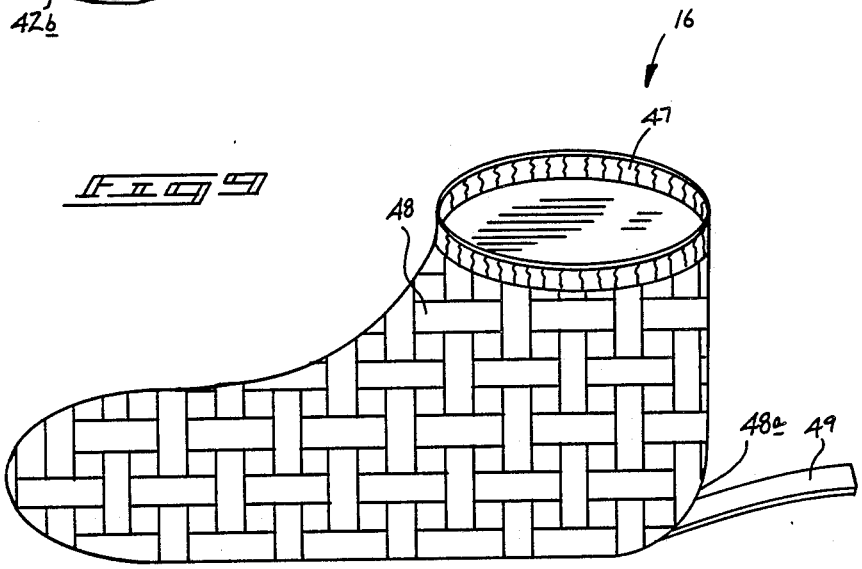

PROTECTIVE FOOT COVERING

BACKGROUND OF THE INVENTION

1. Field of the Invention

The field of invention relates to shoe coverings, and more particularly pertains to a new and improved protective foot covering wherein the same is readily secured overlying an individual's foot and shoe to maintain debris within the covering.

2. Description of the Prior Art

Foot coverings of various types have been set forth in the prior art to accommodate shoes or foot insertions therein. Coverings of the prior art have utilized composite configurations of various fabrics and polymerics to effect a covering. For example, U.S. Pat. 4,023,281 to Terry sets forth an outer shoe covering formed of a tubular lower portion with a first elastomeric band and a second ankle portion with a second elastomeric band for securement and covering of an associated shoe.

U.S. Pat. 4,272,859 to Vanhove sets forth an overshoe formed of a non-woven fabric formed with elastomeric upper band for securement about a shoe wherein the covering is formed of two identical sheets of parallelogram configurations connected along one of their larGe sides by a gusset secured to the sole and along the small sides to join the opposite faces of the gusset for completing the covering structure for surrounding of the shoe.

U.S. Pat. 4,538,368 sets forth an overshoe with a flexible interior sock-like lining for receiving a foot therewithin.

U.S. Pat. 4,610,042 to Theodorsen sets forth a method and apparatus for forming an overshoe wherein spaced sheets are secured together to form a disposable overshoe covering.

U.S. Pat. 4,616,428 to Leger sets forth a slipper formed with a gathered and elastomeric upper end sewn to bottom portion for temporary covering of shoes and the like in medical and industrial applications.

As such, it may be appreciated that there is a continuing need for a new and improved protective foot covering wherein the same addresses both the problems of ease of use and effectiveness in construction, and in this respect, the present invention substantially fulfills this need.

SUMMARY OF THE INVENTION

In view of the foregoing disadvantages inherent in the known types of protective foot coverings now present in the prior art, the present invention provides a protective foot covering wherein the same includes a flexible sole secured to an elastic upper portion for securement overlying and enveloping a shoe-clad foot of an Individual. As such, the general purpose of the present invention, which will be described subsequently in greater detail, is to provide a new and improved protective foot covering which has all the advantages of the prior art protective foot coverings and none of the disadvantages.

To attain this, the present invention includes a flexible, elongate sole of a length substantially equal to that of a shoe with an elastic upper portion secured thereto. The upper portion includes a variety of securement members including hook and loop fasteners positioned on either side of a "V" shaped slot formed to an upper surface of the upper portion positioned rearwardly of the toe portion and a flexible tab secured to a heel portion of the shoe. A mesh upper portion may be utilized, as well as a Spandex for forming the upper portion of the covering. The sole may include grooves and/or recesses for receiving and directing dirt and debris from the associated foot and directing such debris interiorly of the sole.

The protective foot covering specifically comprises;

an elongate flexible sole formed with a planar upper surface at a top portion terminating forwardly to a toe portion.

The top portion including a top panel overlying a forward portion of the upper surface of the flexible sole fixedly mounted to the flexible sole, the flexible sole including a surrounding perimeter edge.

The upper surface of the flexible sole includes at least one elongate groove formed medially in the upper surface and extending longitudinally and coextensively therein, and plural pairs of tributary grooves in communication with the elongate groove are formed in the upper surface spaced from the perimeter edge wherein the elongate groove and the tributary grooves are positioned to underlie an associated foot or shoe positioned within the foot covering.

The elongated groove comprises a single continuous through-extending main groove originating through the perimeter edge at a rear terminal edge of the flexible sole and terminating at a forward curvilinear edge of the flexible sole extending through the perimeter edge.

The plural spaced pairs of tributary grooves in communication with the main groove are arranged at an acute angle relative to the main groove and directed rearwardly of the main groove wherein the tributary grooves are wholly contained within the upper surface of the flexible sole.

The top portion is formed of an elastomeric material, and the top portion is defined as a through-extending opening overlying a forward portion of the main grooves adjacent the forward terminal edge of the flexible sole to enhance removal of debris forwardly of the main groove.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective foot covering which has all the advantages of the prior art protective foot coverings and none of the disadvantages.

It is another object of the present invention to provide a new and improved protective foot covering which may be easily and efficiently manufactured and marketed.

It is a further object of the present invention to provide a new and improved protective foot covering which is of a durable and reliable construction.

An even further object of the present invention is to provide a new and improved protective foot covering which is susceptible of a low cost of manufacture with regard to both materials and labor, and which accordingly is then susceptible of low prices of sale to the consuming public, thereby making such protective foot coverings economically available to the buying public.

Still yet another object of the present invention is to provide a new and improved protective foot covering which provides in the apparatuses and methods of the prior art some of the advantages thereof/ while simultaneously overcoming some of the disadvantages normally associated therewith.

Still another object of the present invention is to provide a new and improved protective foot covering wherein the same provides a flexible sole with an elastic upper portion integrally secured thereto for securement overlying and enveloping an associated shoe for temporary covering of such shoes in medical and industrial forums.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein:

FIG. 7 is an orthographic view taken along the lines 7—7 of FIG. 6 in the direction indicated by the arrows.

FIG. 8 is an isometric illustration of the sole construction of FIG. 6 in association with a Spandex upper portion.

FIG. 9 is an isometric illustration of a Spandex mesh construction of the instant invention.

DESCRIPTION OF THE PREFERRED EMBODIMENT

Figure 1:
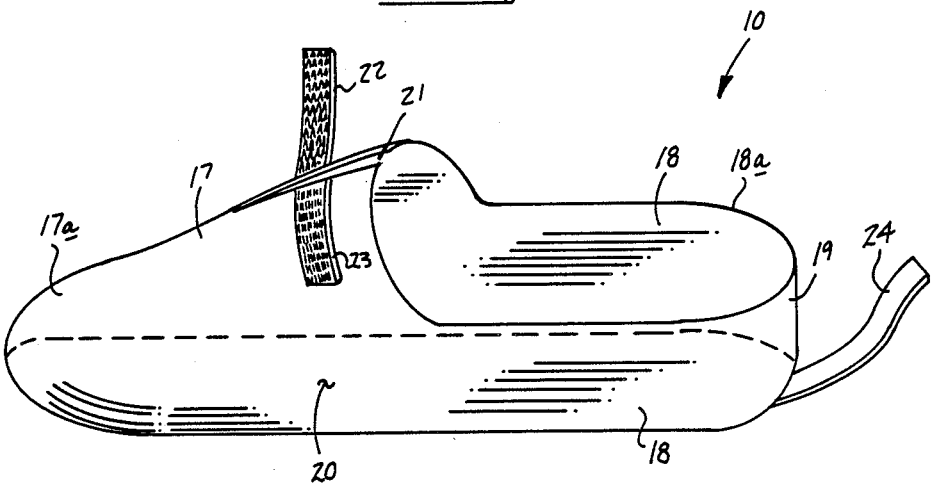
FIG. 1 is an isometric illustration of the instant invention.

With reference now to the drawings, and in particular to FIGS. 1 to 9 thereof, a new and improved protective foot covering embodying the principles and concepts of the present invention and generally designated by the reference numerals 10, 11, 12, 13, 14, 15, and 16 will be described.

More specifically, the protective foot covering 10 of the instant invention essentially comprises a top panel 17 of a length substantially half of that of spaced, elongate side panels 18 of essentially rectangular configuration merging into an arcuate convex rear heel panel 19. A non-elastic sole 20 is coextensively and integrally secured to the side and rear panels 18 and 19 and of a length substantially equal to that of a shoe to be accommodated within the foot covering 10. The sole 20 is non-elastic to maintain a geometric configuration, but to enable flexure during use by an individual. The top panel 17, side panels 18, and rear heel panels 19, as well as a toe portion 17*a*, are all formed of an elastomeric material to accommodate variations in foot and shoe sizes and thereby accept a wide range of such sizes. Generally a polymeric material is utilized for the upper panels of the covering 10. A "V" slot 21 extends from a rear terminal edge of the top panel 17 and extends forwardly thereof, but terminating short of the toe panel 17*a*. The "V" slot enables ease of positioning of a shoe or foot interiorly of the foot covering 10. A first free hook and loop strap 22 is securable to a second hook and loop strap 23 that is integrally secured to an upper surface of the top panel 17. The first and second hook and loop straps are positioned on either side of the "V" slot 21 to enable closure and securement of the "V" slot and securement of a foot positioned therewithin. A flexible fabric tab 24 is integrally secured to an intersection of the heel panel 19 and the sole 20 to enable an individual to step upon the flexible tab 24 with an opposed foot to enhance insertion of the individual's foot to be positioned within the covering 10.

Figure 2:
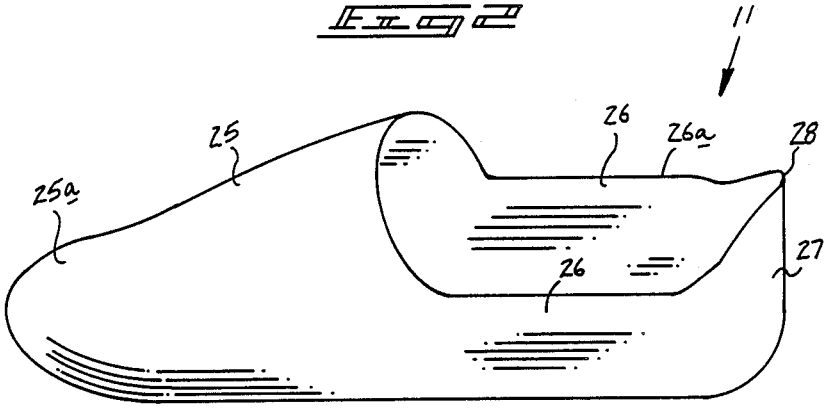
FIG. 2 is an isometric illustration of a further embodiment of the instant invention.

FIG. 2 sets forth foot covering 11 formed with a top panel 12 spaced above and beyond a toe panel 25*a*. Side panels 26 of generally rectangular configuration are integrally blended into and formed with the top and toe panels 25 and 25*a* merging to an arcuate convex rear heel panel 27 that includes an upwardly projecting heel top edge 28 that is spaced above the top edges 26*a* of the side panels 26 to provide enhanced securement of a foot or shoe positioned interiorly of the foot covering 11. As in the foot covering 10, the sole is formed of a flexible, non-elastic material and wherein the panels spaced thereabove are formed of an elastomeric material to stretch and accommodate a spectrum of varying sizes of shoes and feet to be positioned within the covering 11.

Figure 3:
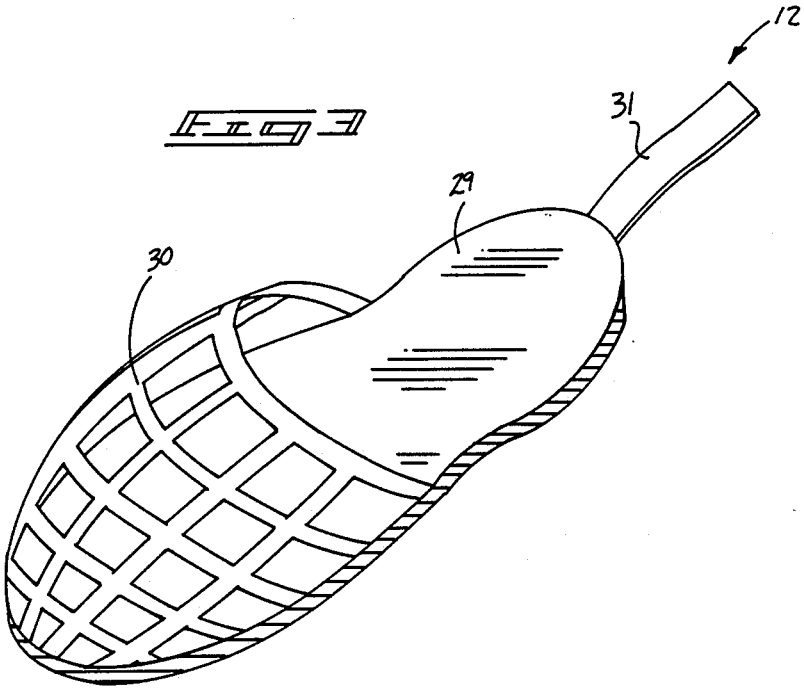
FIG. 3 is an isometric illustration of a third embodiment of the instant invention.

FIG. 3 is illustrative of a further embodiment foot covering 12 formed with a flexible, non-elastic sole 29 with an overlying mesh top panel 30 formed as an opening grid of polygonal openings to provide enhanced air circulation to a foot or shoe positioned therewithin, with a rear flexible cloth tab 31 integrally secured to a rear terminal end surface of the sole 29. The mesh top panel 30 is positioned forwardly and extends to overlie substantially two-thirds of the upper surface of the sole 29.

Figure 4:
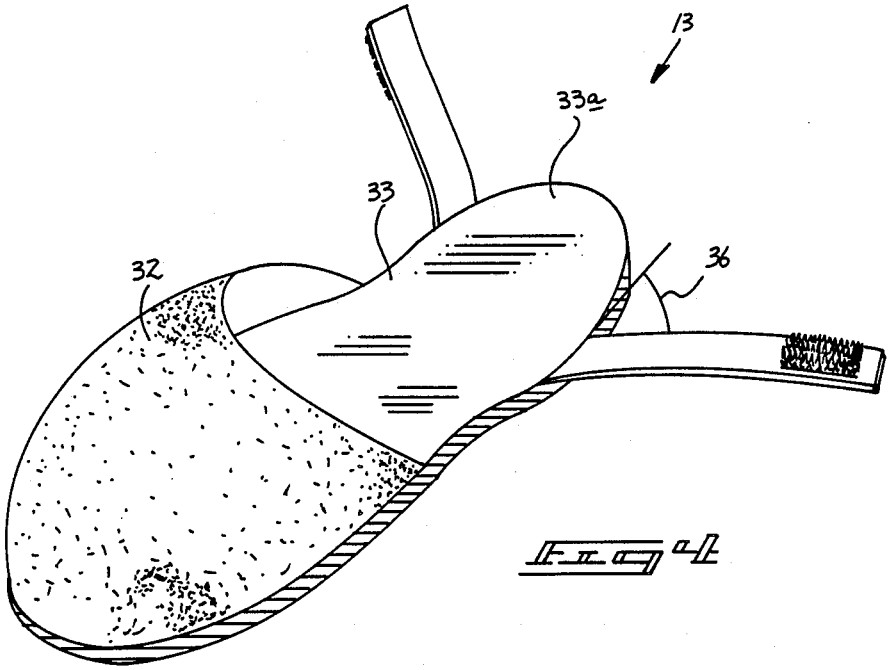
FIG. 4 is an isometric illustration of a fourth embodiment of the instant invention.

FIG. 4 is illustrative of yet a further embodiment foot covering 13 formed with an enclosed, elastic Spandex top panel 32 with a non-elastic flexible sole 33 underlying and integrally secured to the top panel 32. A first hook and loop heel strap 34 cooperates with a second hook and loop heel strap 35 which are oriented and directed rearwardly and integrally secured to upper edges of the sole 33. Each heel strap 34 and 35 is arranged at an acute angle relative to a top edge of the heel portion of sole 33*a* to define an acute angle 36, as illustrated in FIG. 4, to grasp an enclosed heel positioned within the foot covering 13.

Figure 5:
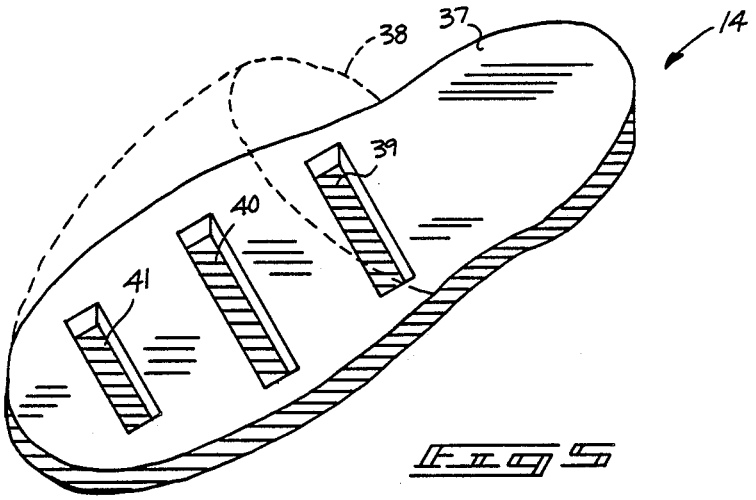
FIG. 5 is an isometric illustration of a sole structure of the instant invention.

FIG. 5 is illustrative of a protective foot covering 14 including a unitary, flexible sole 37 and a top portion 38 defined as a hood with a rear foot opening directed therefrom. The flexible sole 87 includes a series of parallel grooves defined as a first groove 39, a second groove 40, and a third groove 41. The first groove is of a first length spaced forwardly of a rear terminal edge of the sole 37 underlying the top portion 38, with the second groove 40 of a second intermediate length greater than the length of the first and third groove, and with the third groove of a length greater than that of the first groove to accommodate the varying width of the sole 37 underlying the top portion 38 and thereby receive and accommodate debris, perspiration, and the like from a foot or shoe positioned within the foot covering 14.

Figure 6:
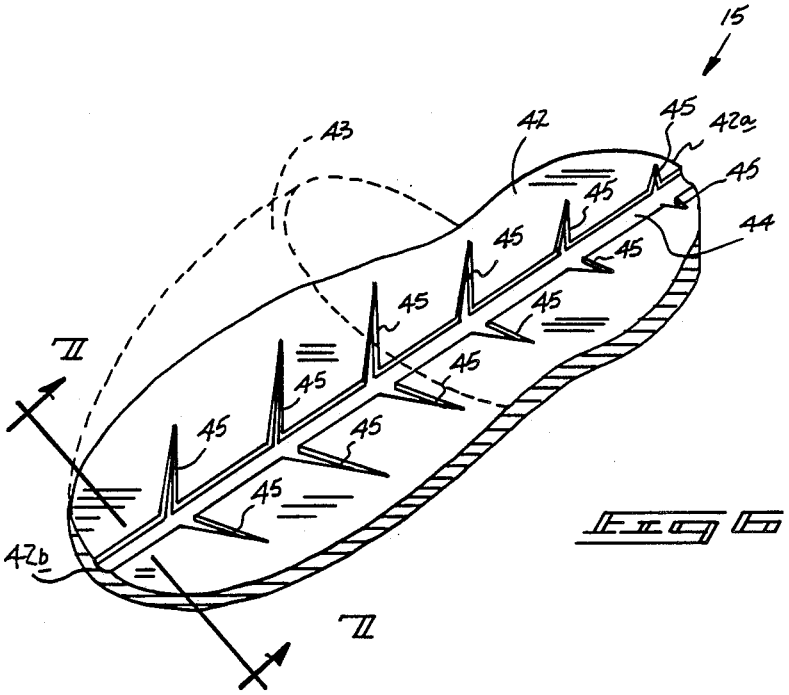
FIG. 6 is, an isometric illustration of a further sole construction of the instant invention.

FIG. 6 is illustrative of a foot covering 15 with a top portion 43 that, like the top portion 38, may be formed of a Spandex-type material. The flexible sole 42 is defined with a rear curvilinear heel edge 42*a* and a curvilinear forward toe edge 42*b* aligned forwardly of the rear heel edge 42*a*. A shallow, trough shaped main groove 44 is coextensively formed within the surface of the sole 42 and directed below the top surface thereof to bisect the rear and forward heel and toe edges respectively 42*a* and 42*b*. Plural spaced pairs of tributary grooves 45 are aligned at acute angles and directed rearwardly of the main groove 44 to enhance directing of perspiration and dirt to the main groove as an individual's foot or shoe is directed forwardly over the top surface of the sole 42. The invention as illustrated in FIG. 7 illustrates the linear and aligned groove 44. FIG. 8 illustrates the top portion 40 as formed of a Spandex material with an open toe oriented overlying the forward toe edge 42*b* to enhance circulation and discharge of fluid and dirt exteriorly of the forward toe edge 42*b*.

FIG. 9 is illustrative of the foot covering 16 formed with an elastomeric top encircling band 47 overlying a main body formed of an elastic Spandex mesh 48 interlaced relative to one another to define a main body portion that is of unitary construction and serves as a sole portion as well as the body portion. The foot covering 16 includes a flexible tab 49 integrally secured to a rear heel surface 48*a* of the body portion 48.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A protective foot covering comprising, an elongate flexible sole formed with a planar upper surface at a top portion terminating forwardly to a toe portion, and the top portion including a top panel overlying a forward portion of the upper surface of the flexible sole fixedly mounted to the flexible sole, the flexible sole including a surrounding perimeter edge, and wherein the upper surface of the flexible sole includes at least one elongate groove formed medially in the upper surface and extending longitudinally and coextensively therein, and plural pairs of tributary grooves in communication with the elongate groove are formed in the upper surface spaced from the perimeter edge wherein the elongate groove and the tributary grooves are positioned to underline an associated foot or shoe positioned within the foot covering, and wherein the elongate groove comprises a single continuous through-extending main groove originating through the perimeter edge at a rear terminal edge of the flexible sole and terminating at a forward curvilinear edge of the flexible sole extending through the perimeter edge, and wherein the plural spaced pairs of tributary grooves in communication with the main groove are arranged at an acute angle relative to the main groove and directed rearwardly of the main groove wherein the tributary grooves are wholly contained within the upper surface of the flexible sole, and wherein the top portion is formed of an elastomeric material, and wherein the toe portion is defined as a through-extending opening overlying a forward portion of the main grooves adjacent the forward terminal edge of the flexible sole to enhance removal of debris forwardly of the main groove.

* * * * *